US009604805B2

(12) United States Patent
Enomoto

(10) Patent No.: US 9,604,805 B2
(45) Date of Patent: Mar. 28, 2017

(54) SHEET FEEDER

(71) Applicant: Shinnosuke Enomoto, Yamanashi-ken (JP)

(72) Inventor: Shinnosuke Enomoto, Yamanashi-ken (JP)

(73) Assignee: NISCA CORPORATION, Minamikoma-gun, Yamanashi-ken (JP)

( * ) Notice: Subject to any disclaimer, the term of this patent is extended or adjusted under 35 U.S.C. 154(b) by 0 days.

(21) Appl. No.: 14/962,617

(22) Filed: Dec. 8, 2015

(65) Prior Publication Data

US 2016/0167905 A1 Jun. 16, 2016

(30) Foreign Application Priority Data

Dec. 10, 2014 (JP) ..... 2014-250259

(51) Int. Cl.
*B65H 3/48* (2006.01)
*B65H 7/02* (2006.01)
*B65H 5/06* (2006.01)

(52) U.S. Cl.
CPC ..... *B65H 5/062* (2013.01); *B65H 3/48* (2013.01); *B65H 7/02* (2013.01); *B65H 2511/51* (2013.01); *B65H 2511/515* (2013.01); *B65H 2511/524* (2013.01); *B65H 2513/50* (2013.01); *B65H 2515/212* (2013.01)

(58) Field of Classification Search
CPC ... B65H 3/06; B65H 3/14; B65H 3/48; B65H 3/52; B65H 7/06; B65H 7/12; B65H 7/125; B65H 7/18; B65H 2406/12
USPC ..... 271/97
See application file for complete search history.

(56) References Cited

U.S. PATENT DOCUMENTS 6,279,896 B1 * 8/2001 Linder et al. ..... B65H 1/18 271/105
6,354,585 B1 * 3/2002 Takahashi ..... B65H 1/14 271/97
7,748,698 B2 * 7/2010 Shelhart ..... B65H 3/48 271/97
2011/0316220 A1 * 12/2011 Yoshii ..... B65H 3/48 271/11
2014/0191461 A1 * 7/2014 Umemoto et al. ..... B65H 3/128 271/12
2014/0339759 A1 * 11/2014 Takahashi et al. .... B65H 1/025 271/11
2015/0239692 A1 * 8/2015 Furuichi et al. ..... B65H 3/128 271/11

FOREIGN PATENT DOCUMENTS

JP 2007-297149 A 11/2007
JP 2009-161282 A 7/2009

* cited by examiner

*Primary Examiner* — David H Bollinger
(74) *Attorney, Agent, or Firm* — Manabu Kanesaka

(57) ABSTRACT

The present invention provides a sheet feeder including a stack tray on which the sheets are stacked, a feeding mechanism that separates and feeds one by one the sheets on the stack tray, a blowing mechanism that blows a predetermined amount of air against the sheets on the stack tray. An operation of the feeding mechanism and an amount of air to be blown by the blowing mechanism are controlled in association with each other, so that it is possible to prevent double-feeding of the sheets and a feeding failure, thereby achieving reliable sheet feeding.

11 Claims, 8 Drawing Sheets

SHEET FEEDER

CROSS-REFERENCE TO RELATED APPLICATIONS

The present application claims priority from Japanese Application No. 2014-250259 filed Dec. 10, 2014, which is incorporated by reference in its entirety.

BACKGROUND OF THE INVENTION

Field of the Invention

The present invention relates to a sheet feeder having a configuration for preventing a sheet feeding failure.

Description of the Related Art

An image forming device, such as a printer or a copier, is provided internally or externally with a sheet feeder for continuously conveying sheets stacked on a stack tray one by one. The sheet feeder has an elevating stack tray on which the sheets are stacked, a delivery roller that is brought into contact with an upper surface of the sheet stack to deliver the sheets, a feeding roller and a separating member that separate and feed one by one the delivered sheets, and a conveying roller pair that conveys the fed sheet toward the image forming apparatus. The sheets on the stack tray are sequentially guided toward the image processing section by the above delivery, separating, and conveying rollers.

As a separating mechanism that separates the sheets one from another, there is known so-called a friction separation system constituted by a feeding roller that feeds the sheet as described above and a separating member which is a separating pad or a separating roller that is brought into contact with an outer peripheral surface of the feeding roller. In such a friction separation system, a surface of the feeding roller or separating member is worn due to age or contact to the sheet, thus deteriorating separating performance. With the deterioration in the separating performance, double-feeding where two or more sheets are fed at the same time in an overlapped manner frequently occurs.

Further, in recent years, types of the sheets to be handled in the image forming apparatus are diversified, and there is a demand for a sheet feeder capable of separating and feeding special sheets, such as OHP sheets, tracing papers, or coated papers. However, such special sheets are more likely to be double-fed than regular papers.

SUMMARY OF THE INVENTION

A sheet feeder includes a stack tray on which the sheets are stacked, a feeding mechanism that separates and feeds one by one the sheets on the stack tray, a blowing mechanism that blows a predetermined amount of air against the sheets on the stack tray. An operation of the feeding mechanism and an amount of air to be blown by the blowing mechanism are controlled in association with each other, so that it is possible to prevent double-feeding of the sheets and a feeding failure, thereby achieving reliable sheet feeding.

DESCRIPTION OF THE PREFERRED EMBODIMENTS

Figure 1:
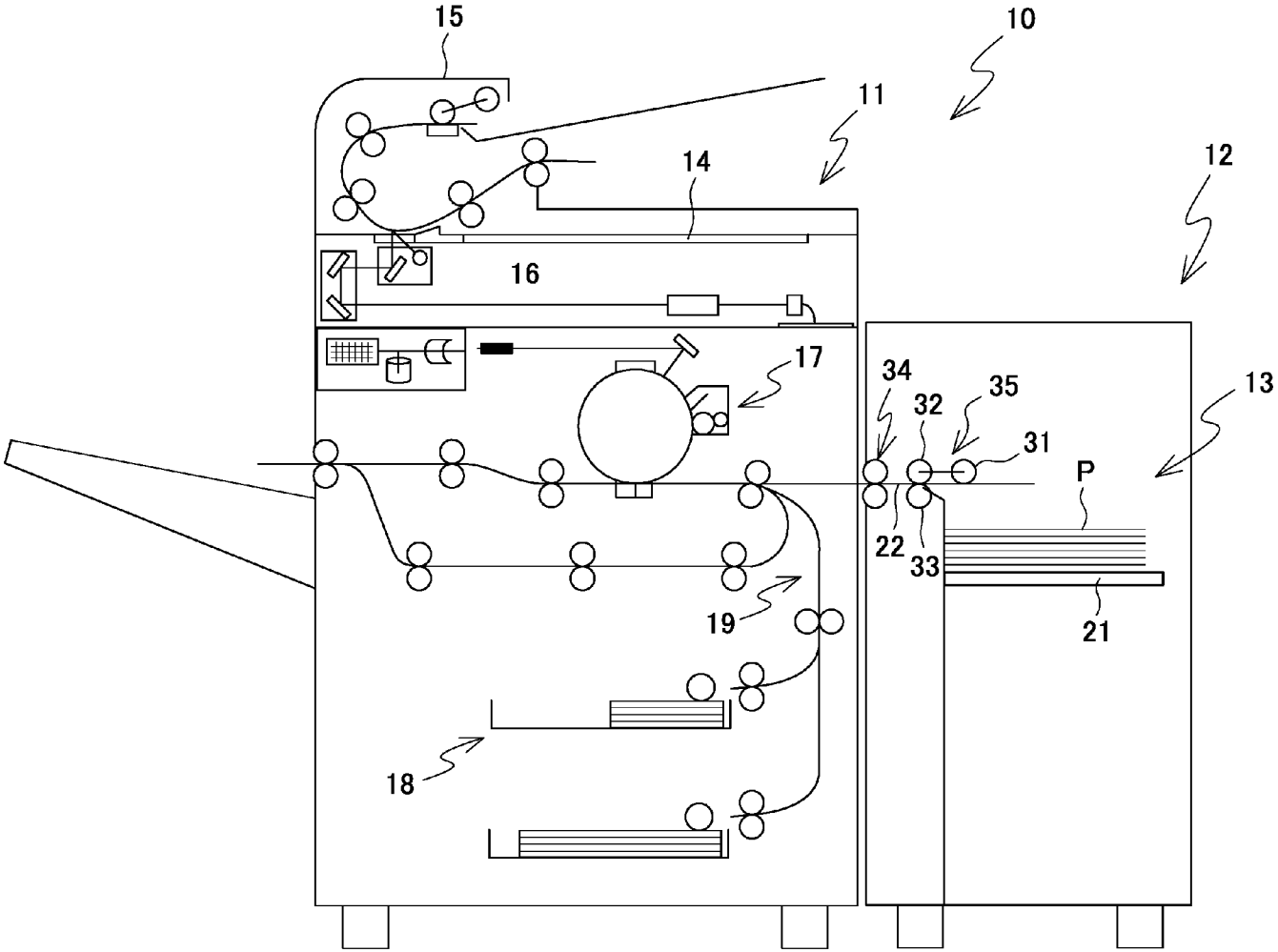
FIG. 1 is a system configuration view of an image formation processing system provided with a sheet feeder according to the present invention.

Hereinafter, an embodiment of a sheet feeder according to the present invention will be described in detail. FIG. 1 illustrates a configuration example of an image formation processing system 10 that can perform processing for a large amount of sheets. The image formation processing system 10 has a configuration obtained by combining a sheet feeder 12 of the present invention with an image forming apparatus 11. The image forming apparatus 11 has a reading mechanism 16 including a platen glass 14 and an ADF 15, an image forming mechanism 17, and a conveying mechanism 19 that feeds sheets from a built-in cassette 18 and conveys the same. The sheet feeder 12 is provided for continuously feeding a large number of sheets from outside to the image forming apparatus 11. The sheet feeder 12 has a stack tray 21 so as to be elevated or lowered with a large number of sheets P stacked thereon. A sheet feeding path 22 extending from the stack tray 21 is connected to the conveying mechanism 19 of the image forming apparatus 11, allowing continuous image formation processing.

Figure 2:
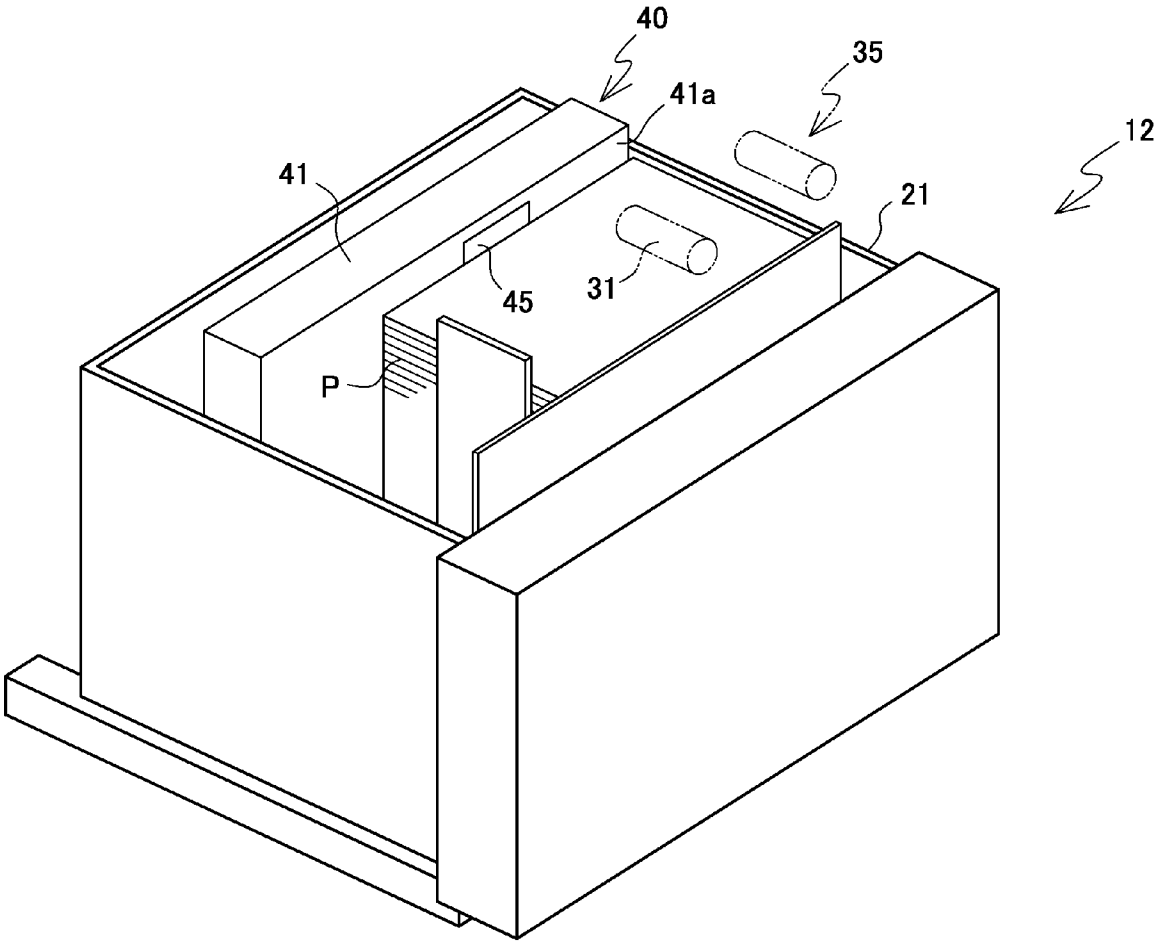
FIG. 2 is a perspective view illustrating a main configuration inside the sheet feeder.
Figure 3:
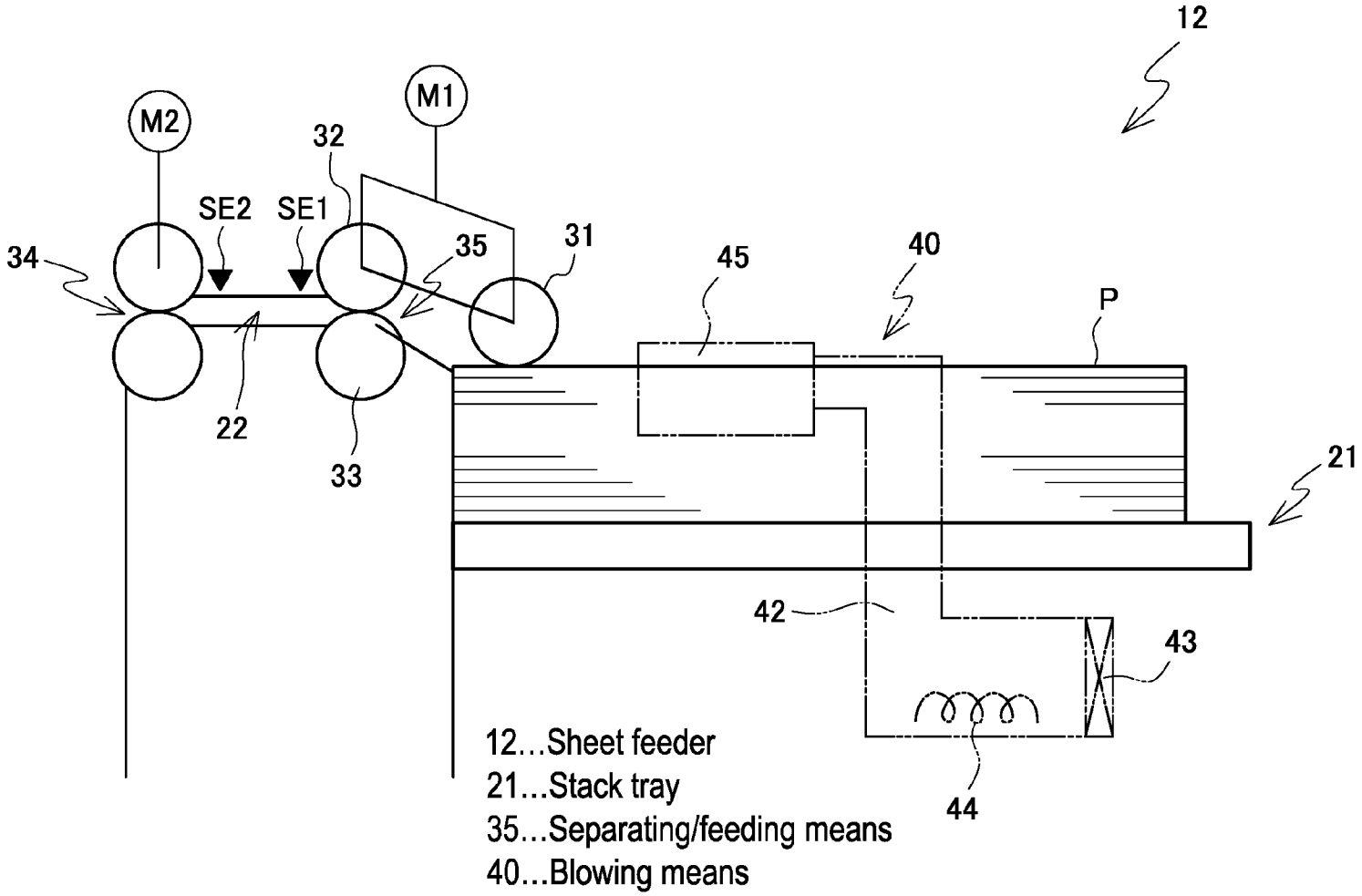
FIG. 3 is a conceptual view illustrating the configuration inside the sheet feeder as viewed from a side surface.
Figure 4:
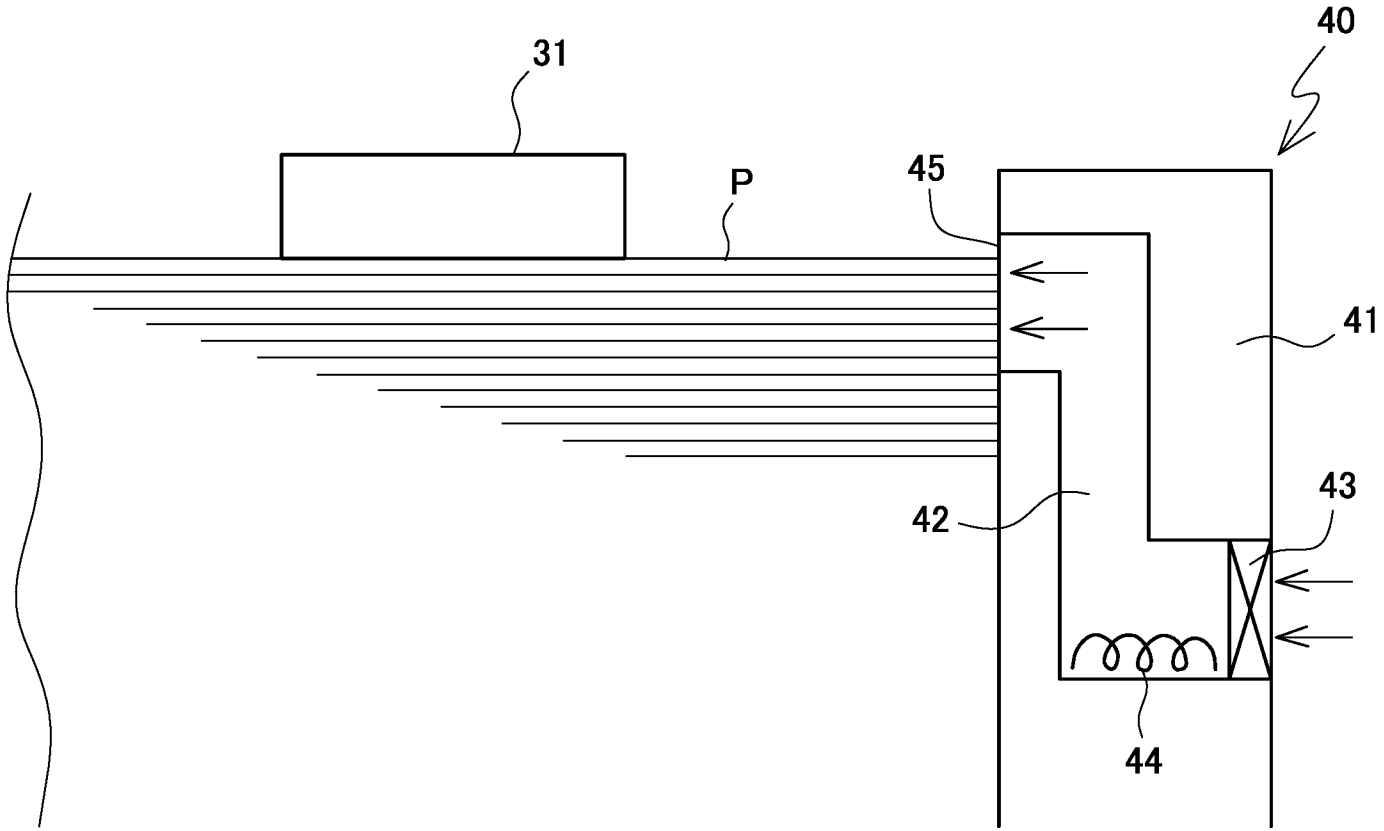
FIG. 4 is a conceptual view illustrating the configuration inside the sheet feeder as viewed from a front.

As illustrated in FIGS. 2 to 4, the sheet feeder 12 has the elevating stack tray 21, a delivery roller 31 that is brought into contact with a topmost sheet P of the sheet bundle stacked on the stack tray and delivers the sheets, a separating/feeding mechanism 35 including a feeding roller that feeds the sheets delivered by the delivery roller 31 and a separating roller 33 that is brought into pressure contact with the feeding roller 32 to separate the sheets, and a conveying roller pair 34 provided on a downstream side of the sheet feeding path 22. A sheet detection mechanism that measures a sheet feeding timing is provided downstream of the separating/feeding mechanism 35. The sheet detection mechanism is disposed near a downstream side of the separating/feeding mechanism 35 and includes a first sheet sensor (separation sensor) SE1 that detects presence/absence of the sheet separately fed by the feeding roller 32 and the separating roller 33 and a second sheet sensor (conveyance sensor) SE2 that detects a rear end of the sheet nipped by the conveying roller pair 34.

Upon activation of the sheet feeder 12 having the above configuration, the topmost surface of the sheet bundle on the stack tray 21 is elevated toward a delivery position at which the sheets can be delivered by the delivery roller 31. Then, the sheets are delivered by the delivery roller 31, separated by the separating/feeding mechanism 35, and conveyed toward the image forming apparatus 11 by the conveying roller pair 34. The stack tray 21 is elevation controlled such that the topmost surface of the sheet bundle comes to the delivery position every time the delivery roller 31 delivers a predetermined number of sheets.

A blowing mechanism (blowing unit) 40 for eliminating adhesion between the stacked sheets is provided in the stack tray 21. The blowing unit 40 has a side regulating plate 41 that regulates a side surface of the sheet bundle stacked on the stack tray 21, a blowing duct 42 provided in the side regulating plate 41, a blowing fan 43 that supplies air inside the duct 42 from outside, and a heater 44 that heats the air supplied by the blowing fan 43 to a predetermined temperature. The duct 42 extends toward an air outlet 45 formed at an upper portion of a sheet regulating surface 41*a* of the side regulating plate 41. With this configuration, the air supplied by the blowing fan 43 and heated by the heater 44 is blown against the topmost surface of the sheet bundle. A rotation speed of the blowing fan 43 can be switched, and a temperature of the heater 44 can be set to an arbitrary temperature. As described later, by interlocking the rotation control of the blowing fan 43 or temperature control of the heater 44 with drive and stop of the separating/feeding mechanism 35, it is possible to prevent double-feeding of the sheets to thereby achieve smooth sheet feeding operation.

In the separating/feeding mechanism 35, the sheets delivered from the stack tray 21 by the delivery roller 31 are conveyed toward the conveying roller pair 34 while being nipped one by one between the feeding roller 32 and the separating roller 33. When the conveyance sensor SE2 detects a leading end of the sheet P conveyed by the separating/feeding mechanism 35, a nip operation of the conveying roller pair 34 is started.

The sheets delivered from the topmost surface of the stack tray 21 are continuously fed one by one toward the image forming apparatus 11. At this time, double-feeding where two or more sheets are fed at the same time in an overlapped manner may occur. This double-feeding is often caused when the sheets in a bundled state delivered from the stack tray 21 by the delivery roller 31 are adhered to one another due to influence of static electricity or humidity. To cope with this problem, the blowing unit 40 is used to blow air against a sheet immediately before it is delivered by the delivery roller 31. This allows the sheet to be adequately separated to thereby eliminate the adhesion state. Generally, a fixed amount of air is continuously supplied so as not to excessively float the sheet, during a time from when the sheet feeding operation is started to when a series of the feeding operation is completed.

However, when the double-feeding is caused not by the static electricity between the sheets, but by degradation in the separating performance of the separating/feeding mechanism 35 due to wear of the feeding roller 32 or the separating roller 33 or a change in friction coefficient between the sheets associated with influence of temperature or humidity inside the sheet feeder 12, blowing of the fixed amount of air by the blowing unit 40 is insufficient.

Thus, in the sheet feeder 12 of the present embodiment, the following control is performed. That is, a timing among the sheets to be continuously fed is measured. When a feeding failure such as the double-feeding is likely to occur, the sheet feeding operation is once stopped, and the amount of air to be blown against the sheet is increased from a normal set amount. The air amount is set back to the original set amount after elapse of a predetermined time during which it can be determined that the double-feeding does not occur, and the sheet feeding operation is resumed.

Figure 5:
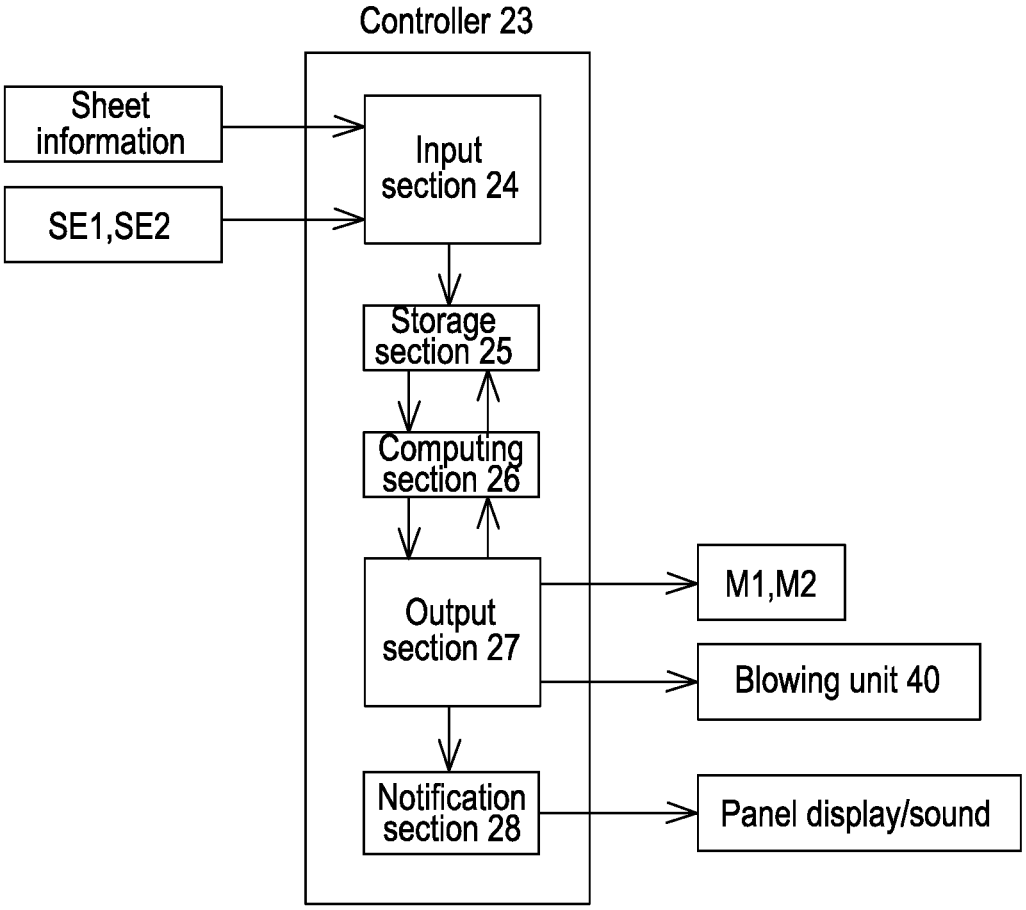
FIG. 5 is a block diagram illustrating a functional configuration of the sheet feeder.

FIG. 5 is a block diagram of a configuration for performing the above control, centering on a controller 23. The controller 23 has an input section 24 that receives an input of setting such as sheet information and a detection signal from each of the separation sensor SE1 and the conveyance sensor SE2, a storage section 25 for storing data or signal input or received to/at the input section 24, a computing section 26, an output section 27 that controls the amount of air from the blowing unit 40, and a notification section 28 that issues a message indicating sheet feeding information, setting of the air amount, and other warnings through a display panel or sound.

Figure 6:
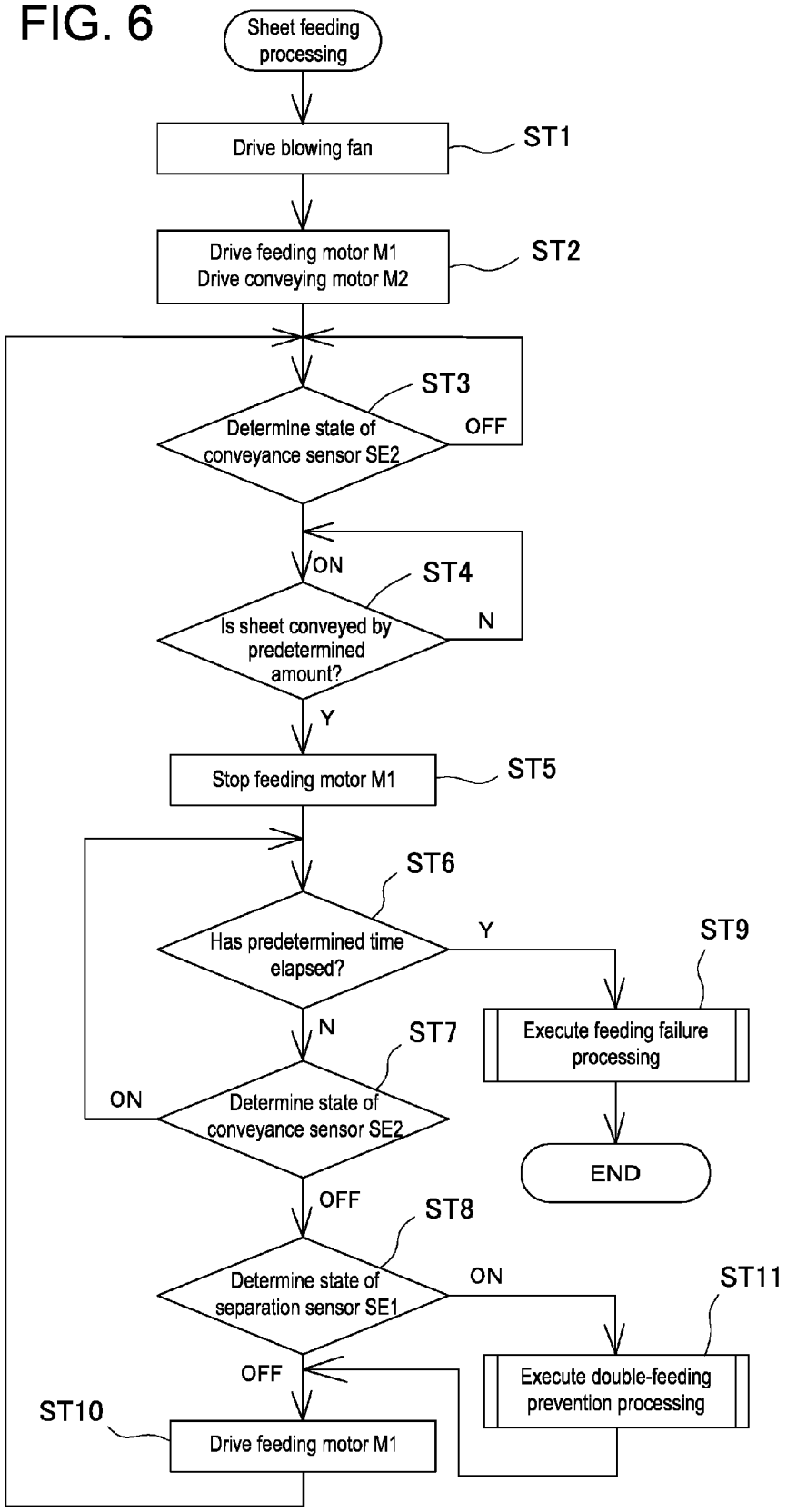
FIG. 6 is a flowchart illustrating a sheet feeding operation performed in the sheet feeder.

The following describes the sheet feeding operation based on the control mechanism with reference to FIGS. 6 and 8A to 8C. As illustrated in FIG. 1, a sheet feeding instruction is received from the image forming apparatus 11 in a state where the stack tray 21 inside the sheet feeder 12 is elevated so as to position the topmost surface of the stacked sheets P at the sheet feeding position. Then, as illustrated in FIG. 6, upon reception of the sheet feeding instruction, the blowing fan 43 of the blowing unit 40 is driven to blow a normal amount of air (ST1). As a result, a fixed amount of air is blown against a side surface of the sheet bundle stacked on the stack tray 21 to adequately separate the several sheets in the sheet bundle. The amount of air to be blown is previously set to a value that does not cause displacement of the sheet bundle or sheet feeding failure.

After start of the air blowing by the blowing unit 40, a feeding motor M1 and a conveying motor M2 are driven (ST2). As a result, the delivery roller 31 and the feeding roller 32 are rotated in a sheet feeding direction. Accordingly, the topmost sheets of the sheet bundle on the stack tray 21 are delivered by the delivery roller 31 and fed toward the conveying roller pair 34 one by one through the separating/feeding mechanism 35 including the feeding roller 32 and the separating roller 33 (see FIG. 8A).

The sheet conveyed in a state of being separated one by one is detected at its leading end by the conveyance sensor SE2 (ST3). The sheet is then conveyed until the leading end thereof is reliably nipped by the conveying roller pair 34 (ST4), and the feeding motor M1 is stopped when the leading end of the sheet is nipped by the conveying roller pair 34 (ST5). Since the conveying motor M2 is still rotated, the sheet is pulled out from the nip portion between the feeding roller 32 and the separating roller 33 by the conveying roller pair 34 to be conveyed toward the image forming section.

Figure 8A:
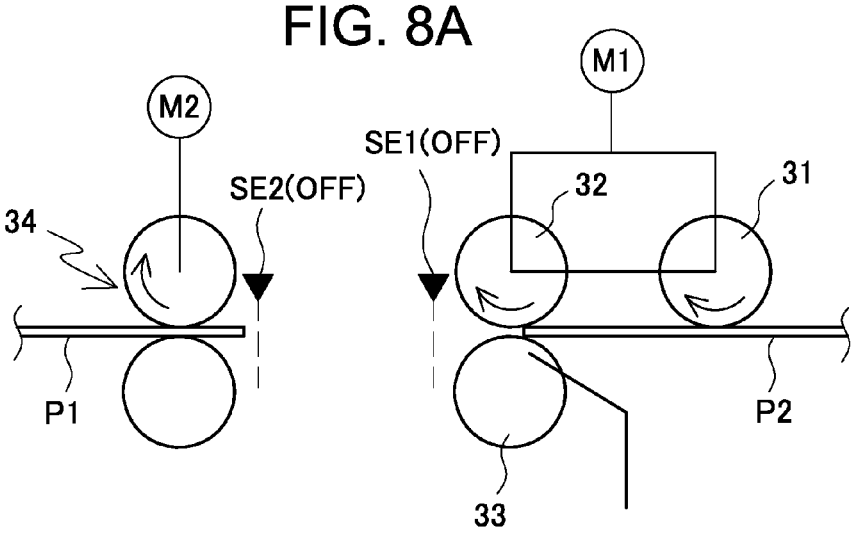
FIGS. 8A to 8C are explanatory views each illustrating a sheet feeding timing in the sheet feeder.
Figure 8B:
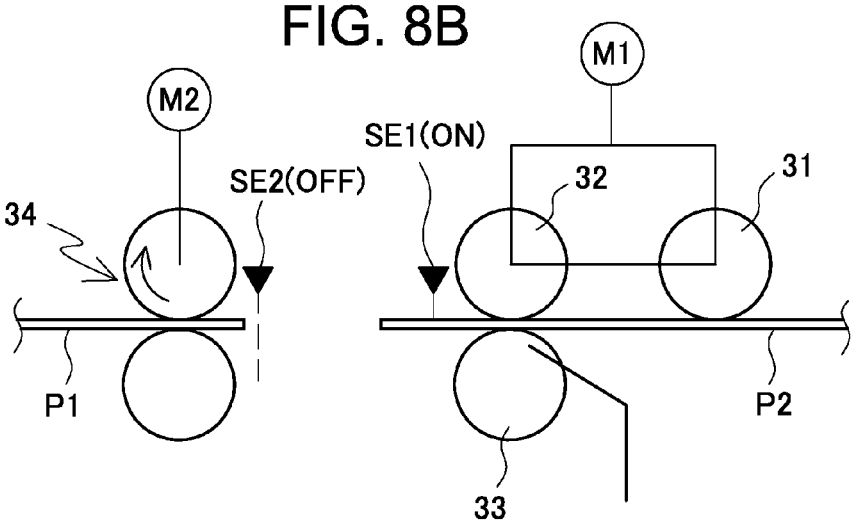

As illustrated in FIG. 8B, when the conveyance sensor SE2 for detecting the sheet conveyed by the conveying roller pair 34 comes into an OFF state within a predetermined time (ST6, ST7), presence/absence of a succeeding sheet P2 is detected by the separation sensor SE1 (ST8).

Figure 8C:
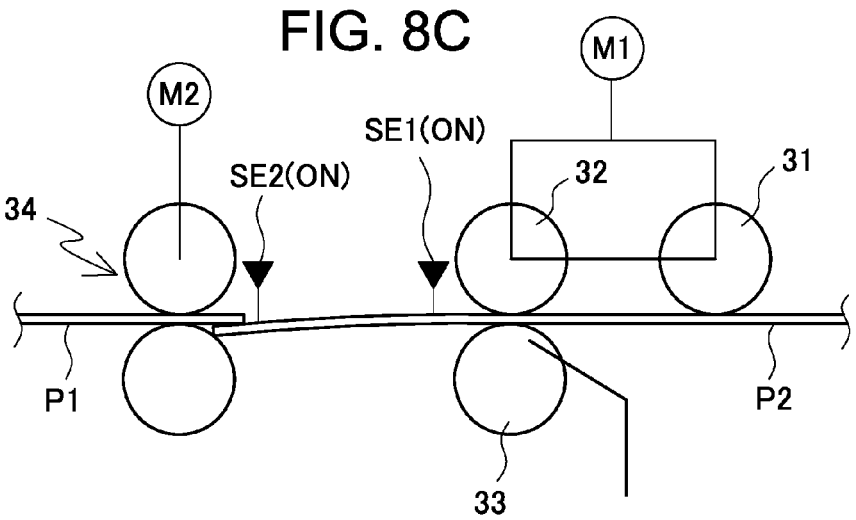

On the other hand, when the conveyance sensor SE2 stays in an ON state even after elapse of a predetermined time, it is determined that the preceding sheet P1 and the succeeding sheet P2 continuously pass through the conveyance sensor SE2 in a partially overlapped state as illustrated in FIG. 8C, and feeding failure processing is then executed (ST9). The predetermined time corresponds to a sheet conveying time during which the sheet is conveyed by a distance obtained by adding a certain distance to a length of the sheet in the conveying direction. That is, the predetermined time corresponds to a time required for a single sheet to pass through the conveyance sensor SE2, and the certain distance to be added is a value obtained in consideration of slippage of the feeding roller 32 or the conveying roller pair 34 at the time of sheet conveyance.

When the conveyance sensor SE2 continues staying in the ON state, the feeding failure processing is executed. First, in the feeding failure processing, the blowing fan 43 and the conveying motor M2 are stopped. Since the feeding motor M1 is stopped at this time, the entire sheet feeding operation in the sheet feeder 12 is stopped. Then, information indicating occurrence of the feeding failure is notified from the notification section 28 to an operator through the display panel or sound.

When the separation sensor SE1 does not detect the succeeding sheet P2 (see FIG. 8A) at a time point when the conveyance sensor SE2 detects a rear end of the sheet P1 (see FIG. 8A), the feeding motor M1 is driven to start the feeding operation of the succeeding sheet P2 (ST10). On the other hand, when the separation sensor SE1 detects the succeeding sheet P2 at a time point when the conveyance sensor SE2 detects the rear end of the sheet P1, it is determined that the double-feeding is likely to occur. Then, double-feeding prevention processing (ST11) is executed and, after completion of the double-feeding prevention processing, the feeding motor M1 is driven to start the feeding operation of the succeeding sheet P2.

Figure 7:
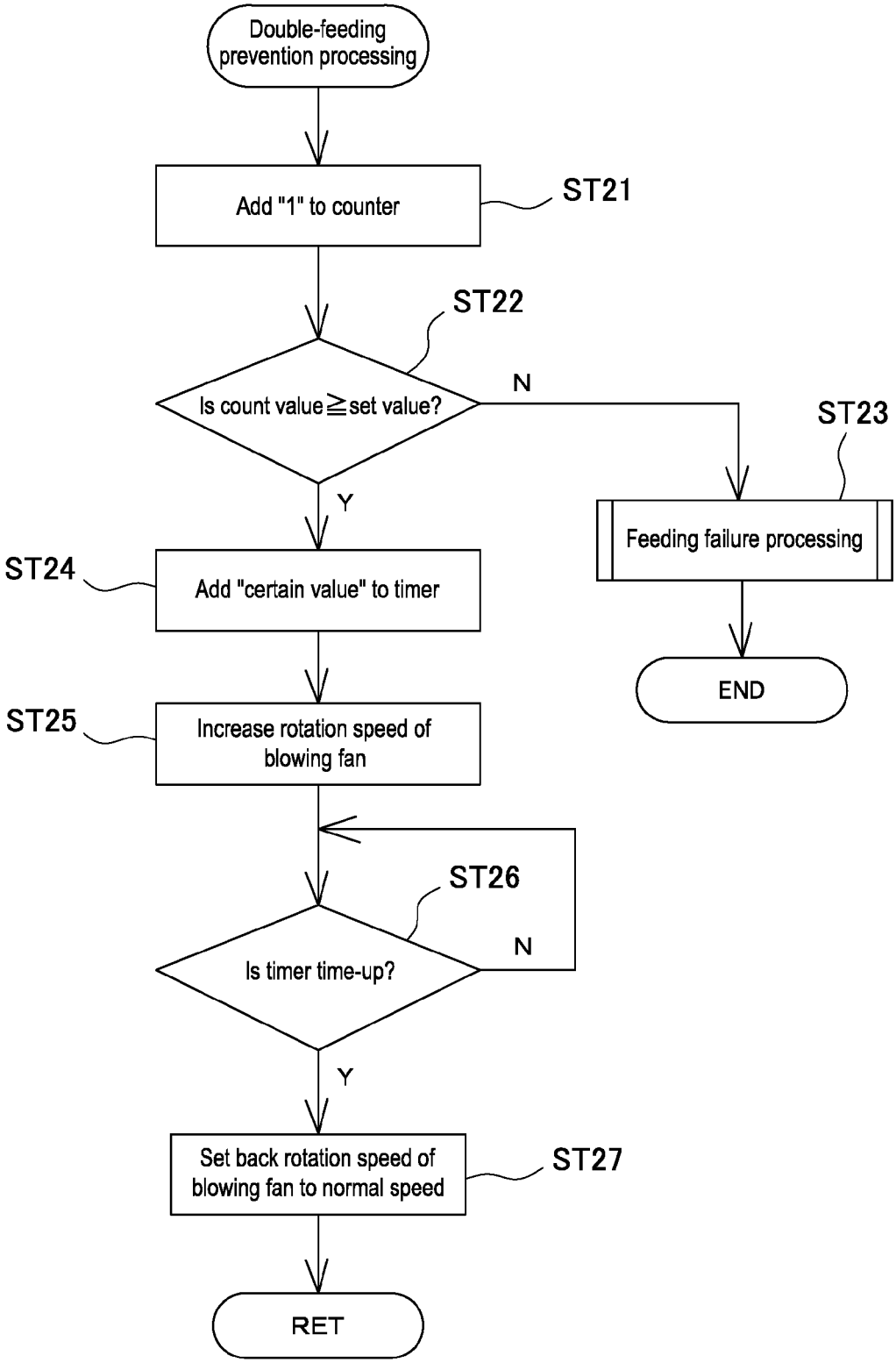
FIG. 7 is a flowchart illustrating double-feeding prevention processing performed in the sheet feeder.

The following describes the double-feeding prevention processing with reference to FIG. 7. First, in the double-feeding prevention processing, "1" is added to a double-feeding prevention counter provided in the computing section 26 of the controller 23 (ST21). When a counter value reaches a prescribed value (ST22), the above-described feeding failure processing is executed (ST23). On the other hand, when a counter value does not reach a prescribed value (ST22), a certain time (e.g., 2 seconds) is added to the timer (ST24), and the rotation speed of the blowing fan 43 is increased to increase the amount of air to be blown against the sheets on the stack tray 21 (ST25). At the same time, the timer is started (ST26). During a time period until the timer reaches a certain time, the rotation speed of the blowing fan 43 is increased from a normal set speed and then returned to the normal set speed (ST27). That is, the air amount is increased from a proper value (normal air amount) to separate the sheets with stronger air and is then returned to the normal air amount that does not affect the sheet feeding operation, followed by feeding operation of the succeeding sheet.

In the embodiment described above, it is determined that the double-feeding is likely to occur when the separation sensor SE1 detects the succeeding sheet P2 at a time point when the conveyance sensor SE2 detects the rear end of the preceding sheet P1. Alternatively, however, the double-feeding prevention processing may be executed when the stack tray 21 is elevated to the sheet delivery position of the delivery roller 31. Further, the double-feeding prevention processing may be executed every time a predetermined number of sheets are delivered by the delivery roller 31. As described above, the double-feeding prevention processing can be executed at an arbitrary timing of the sheet delivery operation, so that it is possible to prevent the double-feeding in all the types of the sheet feeders which performance is different in number of sheets to be supplied or sheet feeding speed.

What is claimed is:

1. A sheet feeder for feeding sheets, comprising:

a stack tray on which the sheets are stacked;

a feeding mechanism that separates and feeds one by one the sheets on the stack tray;

a blowing mechanism that blows a predetermined amount of air against the sheets on the stack tray;

a detection mechanism that detects a feeding state of the sheets fed by the feeding mechanism; and a controller that controls the feeding mechanism and the blowing mechanism based on a result of the detection from the detection mechanism, wherein the controller controls, based on the detection result from the detection mechanism, the feeding mechanism and the blowing mechanism to stop a sheet feeding operation and change the amount of the air to be blown.

2. The sheet feeder according to claim 1, wherein the controller controls, based on the detection result from the detection mechanism, the feeding mechanism and the blowing mechanism to stop the sheet feeding operation and increase the amount of the air to be blown.

3. A sheet feeder for feeding sheets, comprising:

a stack tray on which the sheets are stacked;

a feeding mechanism that separates and feeds one by one the sheets on the stack tray;

a blowing mechanism that blows a predetermined amount of air against the sheets on the stack tray;

a detection mechanism that detects a feeding state of the sheets fed by the feeding mechanism; and a controller that controls the feeding mechanism and the blowing mechanism based on a result of the detection from the detection mechanism, wherein the detection mechanism includes a first sheet sensor that is disposed downstream of the feeding mechanism and configured to detect the sheet and a second sheet sensor that is disposed downstream of the first sheet sensor and configured to detect the sheet, and the detection mechanism detects the feeding state based on whether or not the first sensor detects a succeeding sheet at a time point when the second sheet sensor detects a rear end of a preceding sheet.

4. The sheet feeder according to claim 3, wherein the controller control a sheet feeding operation of the feeding mechanism and amount of air to be blown by the blowing mechanism based on whether or not the first sensor detects the succeeding sheet at the time point when the second sheet sensor detects the rear end of the preceding sheet.

5. A sheet feeder for feeding sheets, comprising:

a stack tray on which the sheets are stacked;

a feeding mechanism that separates and feeds one by one the sheets on the stack tray;

a blowing mechanism that blows air against the sheets on the stack tray; and a controller that controls the blowing mechanism to change an amount of air when a sheet feed operation of the feeding mechanism is stopped and when the sheet feed operation of the feeding mechanism is being performed, wherein the controller controls the blowing mechanism to make a second air amount when the sheet feed operation of the feeding mechanism is stopped larger than a first air amount when the sheet feed operation of the feeding mechanism is being performed.

6. The sheet feeder according to claim 5, wherein the controller changes the amount of air to be blown by the blowing mechanism from the first air amount to the second air amount when the sheet feed operation of the feeding mechanism is stopped at a predetermined timing and changes the amount of air from the second air amount to the first air amount when the sheet feed operation of the feeding mechanism is resumed.

7. The sheet feeder according to claim 5, further comprising a timer for stopping the sheet feeding operation of the feeding mechanism for a certain time period.

8. A sheet feeder for feeding sheets, comprising a stack tray on which the sheets are stacked;

a feeding mechanism that feeds the sheets on the stack tray;

a blowing mechanism that blows air against the sheets on the stack tray;

a detection mechanism that detects a double-feeding state of the sheets fed by the feeding mechanism; and a controller that executes a double-feeding prevention processing by controlling a sheet feeding operation of the feeding mechanism and an amount of air to be blown by the blowing mechanism, wherein the controller performs, based on a detection result from the detection mechanism, the double-feeding prevention processing to stop the sheet feeding operation of the feeding mechanism for a predetermined time period, to change the amount of air to be blown by the blowing mechanism from a first air amount to a second air amount, to change the amount of air from the second air amount to the first air amount after elapse of the predetermined time period, and then to resume the sheet feeding operation of the feeding mechanism, and the second air amount is set larger than the first air amount.

9. The sheet feeder according to claim 8, wherein the detection mechanism includes a first sheet sensor that is disposed downstream of the feeding mechanism and configured to detect the sheet and a second sheet sensor that is disposed downstream of the first sheet sensor and configured to detect the sheet and detects the double-feeding state based on detection results from the first and second sheet sensors.

10. The sheet feeder according to claim 9, wherein the controller executes the double-feeding prevention processing when the first sheet sensor detects a succeeding sheet at a time when the second sheet sensor detects a rear end of a preceding sheet.

11. The sheet feeder according to claim 8, further comprising a counter that counts the number of times that the controller executes the double-feeding prevention processing, wherein the controller stops the sheet feeding operation of the feeding mechanism and air blowing of the blowing mechanism when a counter value of the counter reaches a set value.

* * * * *